US009715195B1

(12) United States Patent
Tanaka

(10) Patent No.: US 9,715,195 B1
(45) Date of Patent: Jul. 25, 2017

(54) TRANSFER DEVICE AND IMAGE FORMING APPARATUS

(71) Applicant: FUJI XEROX CO., LTD., Tokyo (JP)

(72) Inventor: Daisuke Tanaka, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/208,698

(22) Filed: Jul. 13, 2016

(30) Foreign Application Priority Data

Jan. 4, 2016 (JP) ..... 2016-000079

(51) Int. Cl.
*G03G 15/16* (2006.01)

(52) U.S. Cl.
CPC ..... *G03G 15/1665* (2013.01)

(58) Field of Classification Search
CPC ..... G03G 15/1665; G03G 15/1675
USPC ..... 399/44, 45, 66
See application file for complete search history.

(56) References Cited

U.S. PATENT DOCUMENTS 6,434,344 B1 * 8/2002 Yoshida et al. .... G03G 15/1675 399/44
8,045,869 B2 * 10/2011 Kaneyama et al. ..... G03G 15/1625 399/45
8,208,823 B2 * 6/2012 Yoshioka ..... G03G 15/1605 399/66
8,219,001 B2 * 7/2012 Sendo et al. ..... G03G 15/167 399/45

FOREIGN PATENT DOCUMENTS

JP 2014-17631 A 1/2014
JP 2015-11261 A 1/2015

* cited by examiner

*Primary Examiner* — William J Royer
(74) *Attorney, Agent, or Firm* — Sughrue Mion, PLLC

(57) ABSTRACT

A transfer device includes a transfer body, a resistance value measuring unit, and a contact pressure adjusting unit. The transfer body receives a transfer bias and transfers a toner image held on an image carrier which is rotating onto a sheet sandwiched between the transfer body and the image carrier. The resistance value measuring unit measures a resistance value determined by a voltage and a current of the transfer bias. The contact pressure adjusting unit adjusts a contact pressure of the transfer body against the image carrier so that the transfer body will contact the image carrier at a second contact pressure determined based on a first contact pressure. The second contact pressure is equal to or higher than the first contact pressure. The first contact pressure is located at a position at which the resistance value measured by the resistance value measuring unit reaches a predetermined threshold.

6 Claims, 6 Drawing Sheets

FIG. 6

| TEMPERATURE AND HUMIDITY ENVIRONMENTS | CONTACT PRESSURE DIFFERENCE [N] |
|---|---|
| HIGH TEMPERATURE AND HUMIDITY | 5 |
| NORMAL TEMPERATURE AND HUMIDITY | 10 |
| LOW TEMPERATURE AND HUMIDITY | 15 |

FIG. 7

| SHEET TRAY | SHEET TYPE | CONTACT PRESSURE DIFFERENCE [N] |
|---|---|---|
| No.1 | PLAIN PAPER | 0 |
| No.2 | CARDBOARD | 10 |

TRANSFER DEVICE AND IMAGE FORMING APPARATUS

CROSS-REFERENCE TO RELATED APPLICATIONS

This application is based on and claims priority under 35 USC 119 from Japanese Patent Application No. 2016-000079 filed Jan. 4, 2016.

BACKGROUND

Technical Field

The present invention relates to a transfer device and an image forming apparatus.

SUMMARY

According to an aspect of the invention, there is provided a transfer device including a transfer body, a resistance value measuring unit, and a contact pressure adjusting unit. The transfer body receives a transfer bias and transfers a toner image held on an image carrier which is rotating onto a sheet sandwiched between the transfer body and the image carrier. The toner image is generated by developing an electrostatic latent image formed on the image carrier by using toner. The resistance value measuring unit measures a resistance value which is determined by a voltage and a current of the transfer bias. The contact pressure adjusting unit adjusts a contact pressure of the transfer body against the image carrier so that the transfer body will contact the image carrier at a second contact pressure which is determined based on a first contact pressure. The second contact pressure is equal to or higher than the first contact pressure. The first contact pressure is located at a position at which the resistance value measured by the resistance value measuring unit reaches a predetermined threshold.

BRIEF DESCRIPTION OF THE DRAWINGS

An exemplary embodiment of the present invention will be described in detail based on the following figures, wherein:

FIG. 6 illustrates a contact pressure difference table stored in a contact pressure difference memory; and FIG. 7 illustrates a sheet type table stored in a sheet type memory.

DETAILED DESCRIPTION

An exemplary embodiment of the present invention will be described below with reference to the accompanying drawings.

Figure 1:
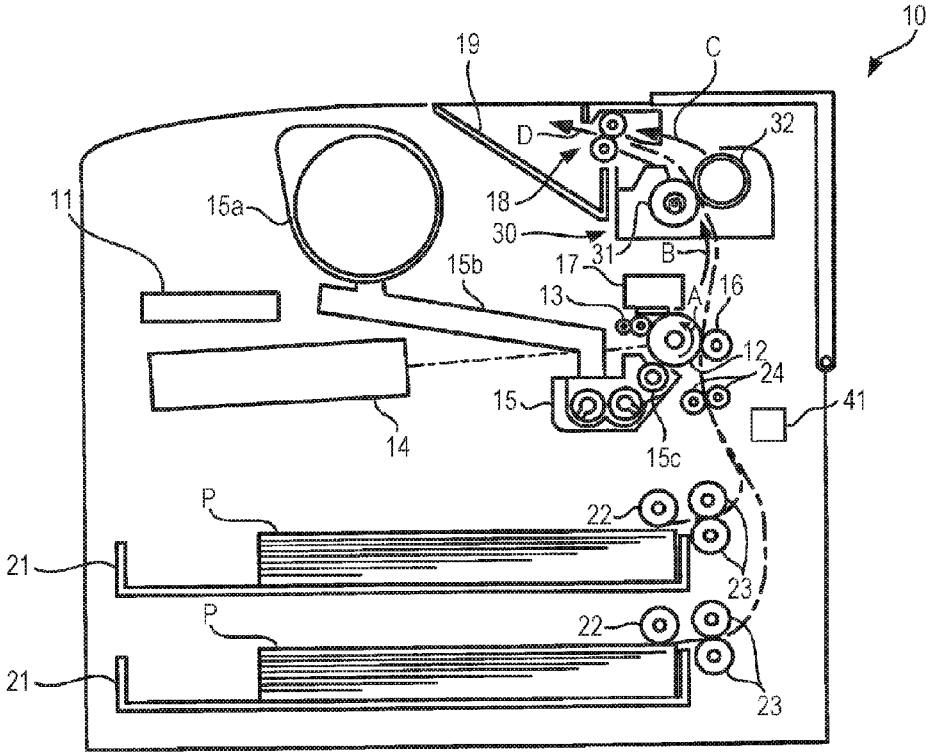
FIG. 1 is a schematic view of a printer used as an image forming apparatus according to an exemplary embodiment.

FIG. 1 is a schematic view of a printer 10 used as an image forming apparatus according to an exemplary embodiment.

The printer 10 shown in FIG. 1 is a monochrome printer including a transfer device of an exemplary embodiment of the invention.

An image signal representing an image generated outside the printer 10 is input into the printer 10 via a signal cable, for example (not shown). The printer 10 includes a controller 11 which controls the operations of the elements of the printer 10. The image signal is input into the controller 11. Under the control of the controller 11, an image based on the image signal is formed in the printer 10.

At the lower portion of the printer 10, two sheet trays 21 are stored. Within the sheet trays 21, sheets P are stacked. The thickness of sheets P stored in one of the trays 21 is different from that in the other tray 21. The sheet trays 21 can be pulled out of the printer 10 so that sheets P can be reloaded in the sheet trays 21.

Sheets P are fed from the sheet tray 21 in which sheets P of a specified type are stored by a pickup roller 22. The sheets P are then separated one by one by separating rollers 23, and one of the separated sheets P is transported upward and the top edge of the sheet P reaches standby rollers 24. The standby rollers 24 serve to adjust the timing at which the sheet P will be transported to the subsequent position. The sheet P is transported in accordance with the timing adjusted by the standby rollers 24.

The printer 10 includes, above the standby rollers 24, a photoconductor 12 which is rotated in the direction indicated by the arrow A in FIG. 1. Around the photoconductor 12, a charger 13, an exposure unit 14, a developing unit 15, a transfer unit 16, and a photoconductor cleaner 17 are disposed.

The photoconductor 12 is formed in a cylindrical shape and extends in the depth direction in FIG. 1. The photoconductor 12 is charged and holds electric charge on the surface of the photoconductor 12, and is then discharged as a result of being exposed to light. As a result, an electrostatic latent image is formed on the surface of the photoconductor 12.

The charger 13 includes a charging roller which is rotated while being in contact with the surface of the photoconductor 12. The surface of the photoconductor 12 is charged by receiving electric charge from the charging roller. Instead of the charging roller, a Corona discharger may be used for charging the surface of the photoconductor 12 in a non-contact manner.

The exposure unit 14 includes a laser emitting device and a rotating polygon mirror. The laser emitting device emits laser light (exposure light) modulated in accordance with an image signal supplied from the controller 11. The rotating polygon mirror scans the photoconductor 12 with the laser light emitted from the laser emitting device. The photoconductor 12 is exposed to light from the exposure unit 14, so that an electrostatic latent image is formed on the surface of the photoconductor 12. Instead of using a laser emitting device for emitting laser light, a light emitting device (LED) array having many LEDs along the scanning direction may be used. An electrostatic latent image may be formed directly by a number of electrodes arranged along the scanning direction, instead of using exposure light.

The electrostatic latent image formed on the surface of the photoconductor 12 as a result of the photoconductor 12 being exposed to light is developed by the developing unit 15. A toner storage portion 15*a* is connected to the developing unit 15 via a toner supply channel 15*b*. In the developing unit 15, a developer containing toner and magnetic carrier is stored, and the toner stored in the toner storage portion 15*a* is supplied to the developing unit 15 via the toner supply channel 15*b* according to the necessity. The magnetic carrier is, for example, iron powder having a resin coating on its surface. Toner particles are made from, for example, a binding resin, a colorant, and a releasing agent. The developing unit 15 agitates the developer containing particles of the magnetic carrier and the toner so as to charge the toner and the magnetic carrier. The developing unit 15 includes a developing roller 15*c*. The developer within the developing unit 15 is supplied to the photoconductor 12 by the developing roller 15*c*, and the electrostatic latent image on the surface of the photoconductor 12 is developed by the charged toner within the developer. As a result, a toner image is formed.

The above-described standby rollers 24 feed a sheet P so that the sheet P will reach a transfer position which opposes the transfer unit 16 in accordance with the timing at which the toner image formed on the photoconductor 12 will reach the transfer position. Then, the toner image on the photoconductor 12 is subjected to the action of a transfer bias applied to the transfer unit 16 and is then transferred onto the sheet P fed by the standby rollers 24.

The toner remaining on the photoconductor 12 after the toner image has been transferred to the sheet P is removed from the photoconductor 12 by the photoconductor cleaner 17.

A combination of the photoconductor 12, the charger 13, the exposure unit 14, and the developing unit 15 correspond to an example of a toner image forming device according to an exemplary embodiment of the invention. The transfer unit 16 corresponds to an example of a transfer body according to an exemplary embodiment of the invention.

The sheet P on which the toner image has been transferred is further transported in the direction indicated by the arrow B in FIG. 1. A fixing unit 30 including a heater 31 and a pressurizer 32 is provided. The sheet P is heated and pressurized when passing through a fixing position between the heater 31 and the pressurizer 32, so that the toner image is fixed on the sheet P. As a result, an image constituted by the fixed toner image is formed on the sheet P. The fixing unit 30 corresponds to an example of a fixing device according to an exemplary embodiment of the invention.

The sheet P passing through the fixing unit 30 is transported toward discharging rollers 18 in the direction indicated by the arrow C in FIG. 1. The sheet P is further transported in the direction indicated by the arrow D in FIG. 1 by the discharging rollers 18 so as to be discharged onto a discharge table 19.

A mechanism in the printer 10 in which a sheet P is extracted from one of the sheet trays 21, passes through the transfer position between the photoconductor 12 and the transfer unit 16, passes through the fixing position between the heater 31 and the pressurizer 32 of the fixing unit 30, and is discharged onto the discharge table 19 corresponds to a sheet transport device according to an exemplary embodiment of the invention.

Figure 2A:
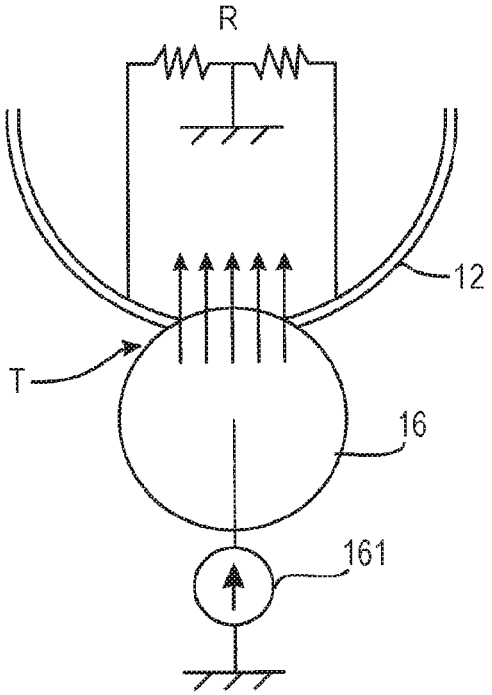
FIGS. 2A and 2B are schematic views illustrating phenomena which may occur due to the contact between a transfer unit and a photoconductor.
Figure 2B:
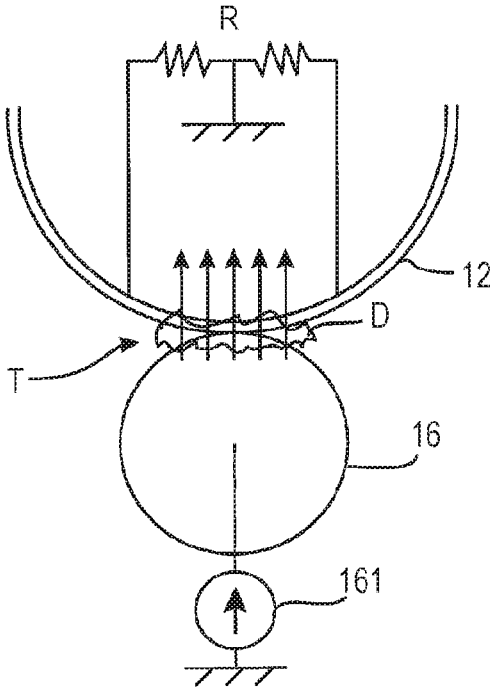

FIGS. 2A and 2B are schematic views illustrating phenomena which may occur when the transfer unit 16 and the photoconductor 12 contact each other.

A transfer bias is applied to the transfer unit 16 by a transfer bias power supply 161. The photoconductor 12 is grounded.

FIG. 2A illustrates a state in which the transfer unit 16 is pressed hard against the photoconductor 12. In this case, a toner image is properly transferred to a sheet which passes through a transfer position T between the photoconductor 12 and the transfer unit 16. On the other hand, however, since the transfer unit 16 is pressed hard against the photoconductor 12, the photoconductor 12 is heavily worn, which may decrease the life of the photoconductor 12.

FIG. 2B illustrates a state in which the transfer unit 16 is pressed gently against the photoconductor 12. In this case, discharging D occurs at a position at which the photoconductor 12 and the transfer unit 16 are slightly separated from each other next to a position at which they contact each other. Because of the occurrence of discharging D, a toner image is not properly transferred to a sheet passing through the transfer position T, which causes a disturbance in the toner image transferred onto the sheet. That is, if the contact pressure of the transfer unit 16 against the photoconductor 12 is too weak, image defects may occur although the life of the photoconductor 12 is increased.

A transfer bias is applied to the transfer unit 16, and, due to the action of the transfer bias, a current is generated and flows through the transfer unit 16 and the photoconductor 12. In this example, a constant-current power supply is used as the transfer bias power supply 161. Accordingly, by measuring the voltage between the transfer unit 16 and the photoconductor 12, the resistance value R therebetween can be measured.

In the state in which the transfer unit 16 is pressed hard against the photoconductor 12, as shown in FIG. 2A, a low voltage (low resistance value) is measured. In the state in which the transfer unit 16 is pressed gently against the photoconductor 12, as shown in FIG. 2B, a high voltage (high resistance value) is measured. The reason for this may be as follows. If the contact pressure between the transfer unit 16 and the photoconductor 12 is low, discharging D occurs, that is, a current path passing through an air space, is generated. A high resistance value in this air space reflects in the measurement result of the voltage (resistance value).

Figure 3:
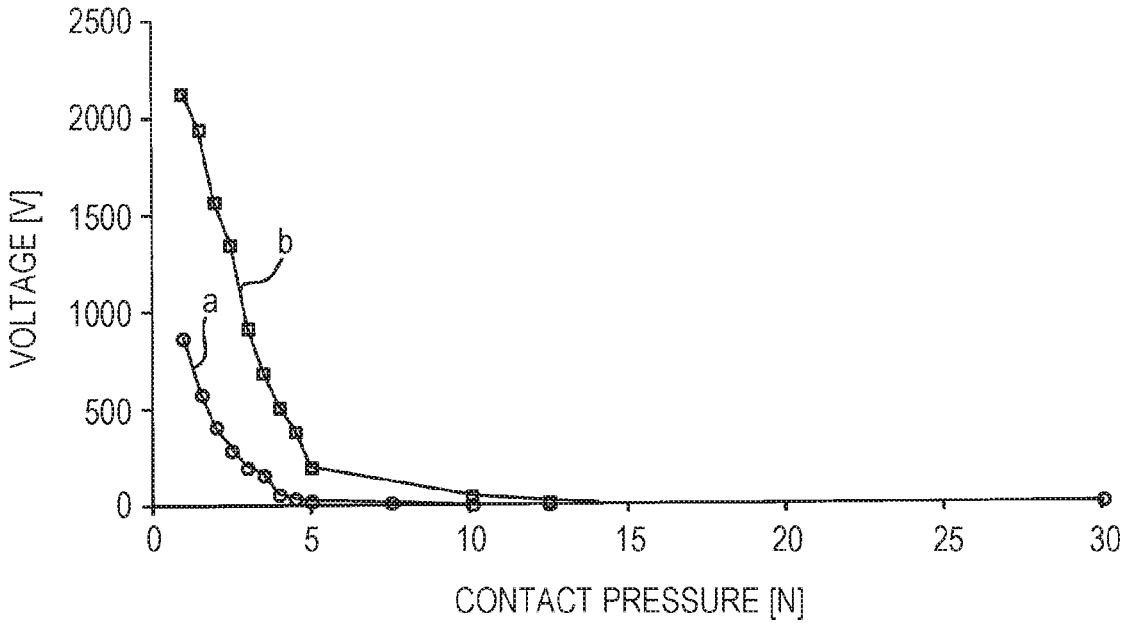
FIG. 3 is a graph illustrating the relationship between the contact pressure and the voltage (resistance value) under different temperature and humidity environments.

FIG. 3 is a graph illustrating the relationship between the contact pressure and the voltage (resistance value) under different temperature and humidity environments.

In the graph of FIG. 3, the horizontal axis indicates the contact pressure [N] of the transfer unit 16 against the photoconductor 12, while the vertical axis indicates the voltage [V] between the photoconductor 12 and the transfer unit 16. As discussed above, since a constant-current transfer bias is applied to the transfer unit 16 in this example, the vertical axis also indicates the resistance value.

In the graph of FIG. 3, two lines representing the voltages with respect to the contact pressure are indicated. One graph a indicates an example of the relationship between the contact pressure and the voltage under high-temperature high-humidity environments. The other graph b indicates an example of the relationship between the contact pressure and the voltage under low-temperature low-humidity environments. The graphs a and b show that, as the pressure contact decreases, the voltage (resistance value) sharply increases. Upon comparing with the graph a (high-temperature high-humidity environments), in the graph b (low-temperature low-humidity environments), the voltage (resistance value) starts to increase when the contact pressure is higher than that in the graph a, and also, at the same contact pressure, the voltage (resistance value) is higher in the graph b.

Figure 4:
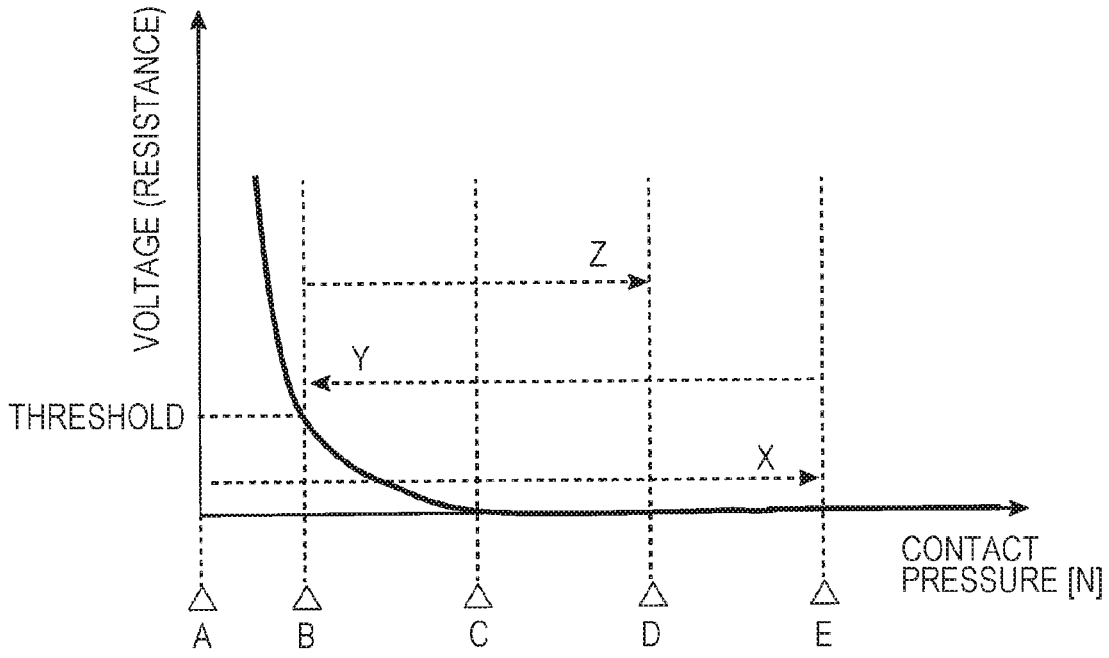
FIG. 4 is a graph illustrating the concept of a contact pressure control method in the exemplary embodiment.

FIG. 4 is a graph illustrating the concept of a contact pressure control method in this exemplary embodiment. In FIG. 4, as well as in FIG. 3, the horizontal axis indicates the contact pressure, while the vertical axis indicates the voltage (resistance value).

In this graph, the position at which the contact pressure is zero, that is, the position at which the transfer unit 16 is separated from the photoconductor 12, is set to be the home position A of the transfer unit 16. A transfer bias is not applied to the transfer unit 16 at the home position A. At the start of the operation of the transfer unit 16, the transfer unit 16 at the home position A is pressed against with the photoconductor 12 so as to gradually increase the contact pressure, as indicated by the arrow X, to the position E at which discharging does not occur or even if it occurs, it is sufficiently small. Then, a transfer bias is applied to the transfer unit 16. Thereafter, the contact pressure is gradually decreased, as indicated by the arrow Y, and then, discharging is started at the position C. The contact pressure is further decreased, and then, the level of discharging reaches a threshold at the position B at which a higher level of discharging is not permitted any more. Then, the contact pressure at the position B is increased to that at the position D by a predetermined contact pressure difference, as indicated by the arrow Z. In this manner, the transfer unit 16 is stably operated so that discharging can be suppressed to a sufficiently low level even with the occurrence of a certain environment change during the operation without having to increase the contact pressure to an excessively high level.

Figure 5:
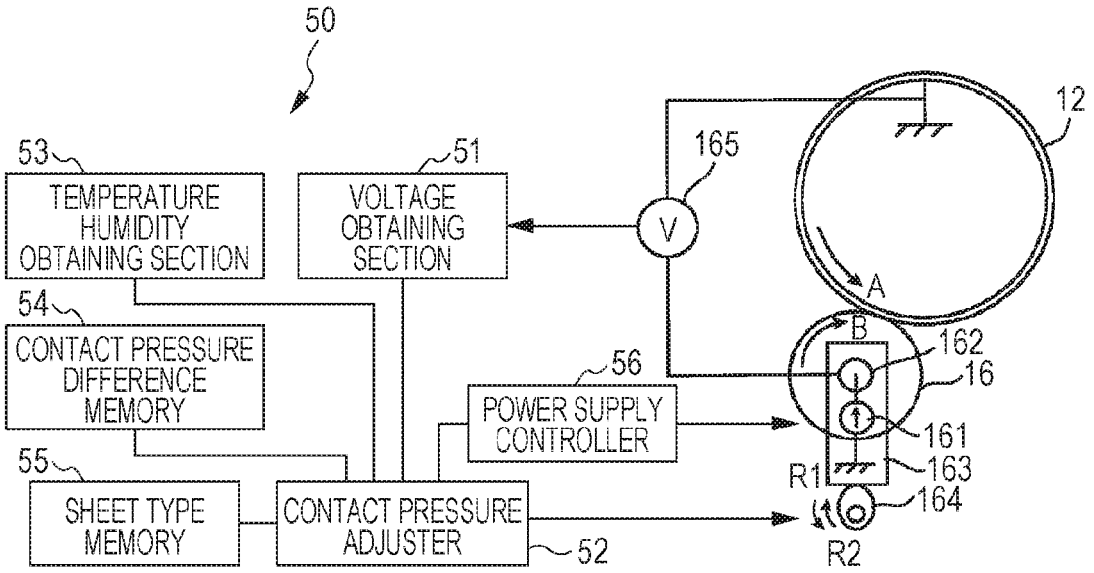
FIG. 5 is a schematic view of the photoconductor and the transfer unit of the printer shown in FIG. 1.

FIG. 5 is a schematic view of the photoconductor 12 and the transfer unit 16 of the printer 10 shown in FIG. 1.

The photoconductor 12 is formed in a hollow cylindrical shape and is grounded. The photoconductor 12 is rotated in the direction indicated by the arrow A in FIG. 5. The transfer unit 16 is formed in a roll-like shape, and a rotating shaft 162 of the transfer unit 16 is rotatably supported by a support member 163. A cam 164 is provided and is rotatable in the directions indicated by the arrows R1 and R2 so as to move the support member 163. With this configuration, the transfer unit 16 is brought into contact with the photoconductor 12 at a contact pressure corresponding to the rotating position of the cam 164.

The transfer bias power supply 161 is also provided so as to apply a transfer bias to the transfer unit 16. As stated above, in this exemplary embodiment, a constant current is supplied as a transfer bias.

By the application of a transfer bias to the transfer unit 16, a current flows between the transfer unit 16 and the photoconductor 12. In this case, a voltmeter 165 which measures the voltage between the transfer bias power supply 161 and the ground point of the photoconductor 12 is provided.

A contact pressure adjusting unit 50 is also provided, as shown in FIG. 5. The controller 11 shown in FIG. 1 serves as the contact pressure adjusting unit 50. The voltage measured by the voltmeter 165 is obtained by a voltage obtaining section 51 and is transmitted to a contact pressure adjuster 52. The temperature and the humidity measured by an environment sensor 41 shown in FIG. 1 are obtained by a temperature humidity obtaining section 53 and are also transmitted to the contact pressure adjuster 52. A contact pressure difference memory 54 and a sheet type memory 55 are also provided. In the contact pressure difference memory 54 and the sheet type memory 55, a contact pressure difference table and a sheet type table, respectively, are stored. The contact pressure adjuster 52 refers to the contact pressure difference table and the sheet type table.

A power supply controller 56 is also provided. The power supply controller 56 performs control including ON/OFF switching of the transfer bias power supply 161.

FIG. 6 illustrates the contact pressure difference table stored in the contact pressure difference memory 54.

In the contact pressure difference table, the temperature and humidity environments and the contact pressure difference are stored in association with each other. The contact pressure difference is the difference in the contact pressure between the position B at which discharging has reached the threshold and the position D at which the contact pressure has been adjusted, as discussed with reference to FIG. 4.

In the contact pressure difference table, the temperature and humidity environments are categorized as three levels, such as the high temperature and humidity, the normal temperature and humidity, and the low temperature and humidity, and are associated with contact pressure differences of 5 [N], 10 [N], and 15 [N], respectively.

FIG. 7 illustrates the sheet type table stored in the sheet type memory 55.

In the sheet type memory 55, the types of sheets stored in the two sheet trays 21 shown in FIG. 1 and the contact pressure differences corresponding to the sheet types are stored. In the example shown in FIG. 7, plain paper and cardboard are respectively stored in the sheet tray 21 of the upper section (No. 1) and the sheet tray 21 of the lower section (No. 2), and are respectively associated with contact pressure differences of 0 [N] and 10 [N].

Referring back to FIG. 5, a description of the adjustment of the contact pressure will continue.

By rotating the cam 164, the contact pressure adjuster 52 increases the contact pressure of the transfer unit 16 at the home position A against the photoconductor 12 to the position E at which discharging does not occur, as discussed with reference to FIG. 4. Then, the power supply controller 56 operates the transfer bias power supply 161 to apply a transfer bias to the transfer unit 16. Then, the contact pressure adjuster 52 gradually decreases the contact pressure. When the measured voltage obtained by the voltage obtaining section 51 has reached the threshold, the contact pressure adjuster 52 starts to increase the contact pressure. In this case, the contact pressure adjuster 52 refers to the contact pressure difference memory 54 and obtains the contact pressure difference associated with the level of the temperature and humidity environments (see FIG. 6) including the temperature and the humidity obtained by the temperature humidity obtaining section 53. Then, the contact pressure adjuster 52 increases the contact pressure from that at the position B (see FIG. 4) at which the voltage has reached the threshold to the contact pressure at the position D in FIG. 4 by the obtained contact pressure difference.

The contact pressure adjusted in this manner (at the position D in FIG. 4) is the basic contact pressure to be used when the printer 10 is operated.

Then, upon receiving an instruction to perform printing, the contact pressure adjuster 52 refers to the sheet type memory 55 (see FIG. 7) and adjusts the contact pressure in accordance with the sheet type used in the printing operation. The contact pressure difference associated with plain paper is zero. Accordingly, if the sheet type used in the printing operation is plain paper, the contact pressure adjuster 52 starts the printing operation by maintaining the basic contact pressure adjusted in the above-described manner. On the other hand, the contact pressure difference associated with cardboard is 10 [N]. Accordingly, if the sheet type used in the printing operation is cardboard, the contact pressure adjuster 52 increases the contact pressure from the basic contact pressure by 10 [N] and then starts the printing operation.

When cardboard is inserted between the photoconductor 12 and the transfer unit 16, the transfer unit 16 is separated from the photoconductor 12 by a greater distance than when plain paper is inserted therebetween. Accordingly, discharging is more likely to occur. Thus, the contact pressure is increased so that the possibility of the occurrence of discharging will be decreased.

Upon completion of the printing operation after increasing the basic contact pressure, the contact pressure adjuster 52 returns the contact pressure to the basic contact pressure. Then, the printer 10 enters the standby mode. When the printer 10 is powered OFF, the contact pressure of the transfer unit 16 returns to the home position A (see FIG. 4).

In this exemplary embodiment, when the printer 10 is powered ON, the above-described contact pressure adjustment processing is executed, except for the adjustment of the contact pressure according to the sheet type. However, in the present invention, the timing at which the contact pressure adjustment processing is executed is not restricted. For example, the contact pressure adjustment processing may be executed every time the number of printed sheets reaches a predetermined number or at a timing at which the temperature and humidity environments measured by the environment sensor 41 are switched from one level to another among the three levels shown in FIG. 6.

In this exemplary embodiment, the contact pressure is adjusted in accordance with the sheet type to be used in the printing operation to be performed. Alternatively, a contact pressure difference with an extra margin may be set, and the adjustments to the contact pressure according to the sheet type may be omitted.

In this exemplary embodiment, the contact pressure is adjusted in accordance with the temperature and humidity environments. However, in this case, too, a contact pressure difference with an extra margin may be set, and the adjustments to the contact pressure according to the temperature and humidity environments may be omitted.

Additionally, the threshold may be set to a lower value, and when the voltage reaches the threshold, the contact pressure at the position at which the voltage has reached the threshold may be maintained without increasing the contact pressure. In this case, however, the contact pressure may be adjusted in real time or sufficiently frequently.

In the above-described exemplary embodiment, a constant current is used as a transfer bias, and information concerning the resistance is obtained by measuring the voltage. However, a constant voltage or a combination of a constant current and a constant voltage may be used as a transfer bias. In this case, information concerning the resistance may be obtained by measuring the current in the case of the use of a constant voltage and by measuring both of the voltage and the current in the case of the use of a constant current and a constant voltage.

In the above-described exemplary embodiment, an example in which the present invention is applied to the printer 10 shown in FIG. 1 has been discussed. However, the present invention may be widely applicable to general devices which form a toner image and transfers it to a sheet.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer body that receives a transfer bias and transfers a toner image held on an image carrier which is rotating onto a sheet sandwiched between the transfer body and the image carrier, the toner image being generated by developing an electrostatic latent image formed on the image carrier by using toner;

a resistance value measuring unit that measures a resistance value which is determined by a voltage and a current of the transfer bias; and a contact pressure adjusting unit that adjusts a contact pressure of the transfer body against the image carrier so that the transfer body will contact the image carrier at a second contact pressure which is determined based on a first contact pressure, the second contact pressure being equal to or higher than the first contact pressure, the first contact pressure being located at a position at which the resistance value measured by the resistance value measuring unit reaches a predetermined threshold.

2. The transfer device according to claim 1, wherein the second contact pressure is higher than the first contact pressure by a predetermined contact pressure difference.

3. The transfer device according to claim 2, further comprising:

an environment measuring unit that measures an environmental temperature and humidity, wherein the predetermined contact pressure difference is a contact pressure difference which is determined in accordance with the environmental temperature and humidity measured by the environment measuring unit.

4. The transfer device according to claim 2, wherein the second contact pressure is determined based on the first contact pressure and in accordance with a type of sheet onto which a toner image is transferred.

5. The transfer device according to claim 1, wherein the second contact pressure is determined based on the first contact pressure and in accordance with a type of sheet onto which a toner image is transferred.

6. An image forming apparatus comprising:

a toner image forming device that includes an image carrier and that forms by using toner a toner image on the image carrier which is rotating by developing an electrostatic latent image formed on the image carrier;

a transfer device including a transfer body that receives a transfer bias and transfers the toner image held on the image carrier onto a sheet sandwiched between the transfer body and the image carrier, a resistance value measuring unit that measures a resistance value which is determined by a voltage and a current of the transfer bias, and a contact pressure adjusting unit that adjusts a contact pressure of the transfer body against the image carrier so that the transfer body will contact the image carrier at a second contact pressure which is determined based on a first contact pressure, the second contact pressure being equal to or higher than the first contact pressure, the first contact pressure being located at a position at which the resistance value measured by the resistance value measuring unit reaches a predetermined threshold;

a fixing device that fixes the toner image transferred onto the sheet on the sheet; and a sheet transport device that transports the sheet so that the sheet passes along a sheet transport path via a transfer position between the image carrier and the transfer body and a fixing position at which the toner image is fixed on the sheet by the fixing device.

* * * * *